US007624602B2

(12) United States Patent
La Belle et al.

(10) Patent No.: US 7,624,602 B2
(45) Date of Patent: Dec. 1, 2009

(54) CORED VANE FOR AN AGITATING DEVICE

(75) Inventors: Kathleen M. La Belle, Lawrence, MI (US); Rick A. Schneider, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 547 days.

(21) Appl. No.: 11/442,947

(22) Filed: May 30, 2006

(65) Prior Publication Data

US 2007/0277563 A1 Dec. 6, 2007

(51) Int. Cl.
*D06F 17/10* (2006.01)

(52) U.S. Cl. ..... 68/133; 68/134

(58) Field of Classification Search ..... 68/133, 68/134

See application file for complete search history.

(56) References Cited

U.S. PATENT DOCUMENTS

| | | | | |
|---|---|---|---|---|
| 113,702 | A | 4/1871 | Stow | |
| 2,032,238 | A | 2/1936 | Watts | 259/101 |
| 2,927,449 | A | 3/1960 | Gerhardt | 68/4 |
| 4,207,760 | A | 6/1980 | Bochan | 68/18 |
| 4,555,919 | A | 12/1985 | Brenner et al. | 68/134 |
| 4,787,220 | A | 11/1988 | Noh | 68/134 |
| 5,651,278 | A | 7/1997 | Pinkowski | 68/134 |
| 6,227,014 | B1 | 5/2001 | Euler et al. | 68/134 |
| 2005/0284197 | A1 * | 12/2005 | Pinkowski et al. | 68/133 |

FOREIGN PATENT DOCUMENTS

| | | |
|---|---|---|
| JP | 2198589 | 8/1990 |
| JP | 6114189 | 4/1994 |

OTHER PUBLICATIONS

Daewoo Electronics Co., Ltd, "Daewoo Air Power Washer", 1996, 4 Pages.

* cited by examiner

*Primary Examiner*—Joseph L Perrin
(74) *Attorney, Agent, or Firm*—Clifton G. Green; McGarry Bair PC

(57) ABSTRACT

A vane for a washing machine agitating device is provided. The agitating device includes a skirt and a center shaft extending upwardly from the skirt. The vane extends radially from the center shaft of the agitating device toward an outer perimeter of the skirt. One end of the vane includes at least two supports defining a cavity there between to lower stress experienced by a hinge point of the vane, thereby minimizing vane breakage.

13 Claims, 4 Drawing Sheets

CORED VANE FOR AN AGITATING DEVICE

BACKGROUND OF THE INVENTION

1. Field of the Invention

The present application relates generally to agitating devices in washing machines. More particularly, the application relates to an improved vane design for such an agitating device that is able to reduce the stress experienced by the vane.

2. Description of Related Art

The general construction of clothes washing machines is well known in the art. A common type of clothes washing machine is a vertical axis washer having an agitating device and incorporating a submersion process. An agitating device can be an impeller, an agipeller, a pulsator, and infusor, or any other structure that may be used for agitating or moving clothes and fluid during the wash process. A perforated wash basket for receiving clothing is mounted in an imperforate tub. A wash liquid of detergent and water is introduced into the basket and tub. An oscillating or unidirectional agitating device is positioned within the wash basket and imparts mechanical energy to the clothing and the wash liquid.

Many agitating devices have fins, or vanes, extending radially from the bottom portion of the agitating device, just above the skirt. Examples of such structures are described in U.S. Pat. No. 6,227,014 (Euler et al.), U.S. Pat. No. 5,651,278 (Pinkowski) and U.S. Pat. No. 4,555,919 (Brenner et al.), all assigned to the assignee of the present application, the disclosure of which are incorporated by reference herein. The vanes help push the clothes in a circular direction around the center post, or barrel, of the agitating device and impart mechanical energy to the swirling wash liquid. The vanes also roll the clothes, that is, the clothes are pulled downward in the water adjacent to the agitating device, and then forced back upward along the inside of the basket.

Traditional vanes were stiff and essentially functioned as a pump. Stiff-vaned agitating devices were limited in the amount of clothes that could be circulated without overheating the drive motor of the drive system of the washing machine. Flexible vanes were developed to increase the amount of clothes that could be washed while staying within the torque level of the drive system of the washing machine. A flexible vane would flex under a heavy load, and upon reversal of stroke direction, the bent vane would quickly flip and bend in the opposite direction, causing an increased push on the garments. The direction of push could be controlled by the hinge point of the vane, the hinge point being the first point where the vane is attached to the skirt of an agitating device moving from the tip of the vane in a direction toward the barrel of the agitating device. For vanes which do not attach to the skirt, the hinge point is the first point at which the vane attaches to the barrel. Thus it was possible to push the clothes outward along the bottom of the wash basket and also impart an upward momentum if desired. The combined effect of the bent vane's surface area and the directional push upon reversal of the stroke direction allowed for increased clothes load washing capacity with the same drive system torque.

Stress is exerted on the vanes as they move the water and clothes in a reciprocating circular direction. The vanes must flex in multiple directions to absorb the stress caused by circulating water and moving clothes without breaking off during the wash process. Stress is concentrated at the hinge point because of the abrupt change in geometry between the base of the vane and tip of the vane.

The stress level in a vane may be increased through two factors. First, changes in vane technology may increase the stress within a vane. For example, over the years, vanes have been made thinner, their outer tips extended further away from the center shaft, and stress loading concentrated near the hinge points of the vanes. Secondly, the increased effectiveness of the vanes has allowed for an increased amount of clothing in the wash process, which in turn increased the stress on the vane.

One alternative to reduce the stress in a vane of an agitating device is to use a blended material or a two-part vane system. A flexible material can be added to the vane during the molding process to change the durableness of the vane. An alternate flexible material may be used to mold the vane tip while the remainder of the agitating device is made out of a stiff material. However, both of these processes significantly increase the cost and complexity of the manufacturing process.

Thus, there must be a balance between the strength and the flexibility of the vanes because they must be strong enough not to break but also flexible enough to reduce fabric abrasion and to promote wash performance. Accordingly, it is desirable to develop a vane blade design that will lower the stress level on the hinge point of the vane to a desirable range to minimize breakage while still being flexible enough to reduce fabric abrasion.

SUMMARY OF THE INVENTION

The present application meets the shortcomings of the prior art by providing an agitating device for a washing machine. The device includes a skirt having a first face and a second face, a center shaft extending from the first face of the skirt, and a plurality of vanes extending from the center shaft. Each vane has a proximal end and a distal end, the proximal end having at least two supports defining a cavity therebetween, and the proximal end being located adjacent the center shaft. The vane further includes a topside and an underside, the underside being located on the first face of the skirt and the topside being located opposite the underside. A depression may be located on the topside of the vane while an indentation for stress relief may be located on the underside of the vane.

The design of the present invention lowers the stress level of the hinge point of the vane to a desirable range. In particular, the present design minimizes breakage of the vane, while still imparting enough flexibility to reduce fabric abrasion and promote wash performance.

DETAILED DESCRIPTION

Figure 1:
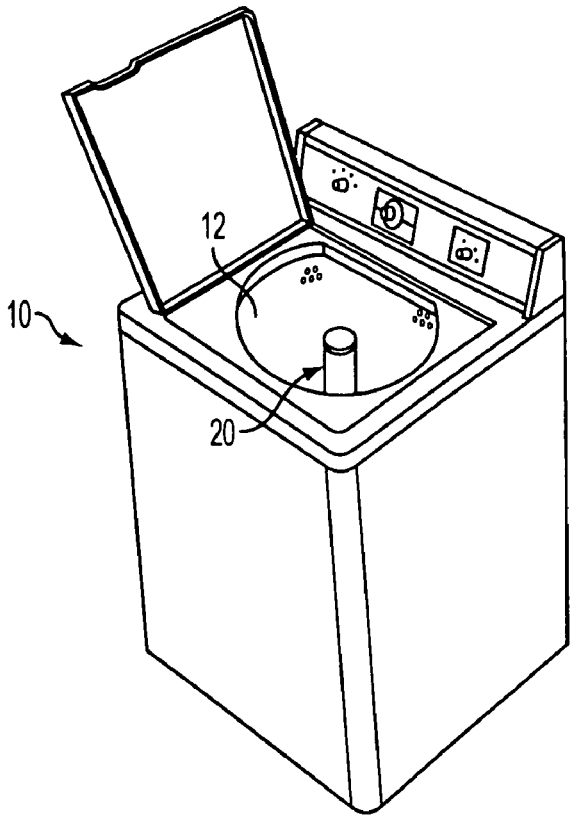
FIG. 1 is a perspective view of a clothes washer having an agitating device according to the present invention.

With reference to FIG. 1, a general vertical axis washing machine 10 is depicted. It should be understood to those skilled in the art that the present invention may be used with any type of vertical axis washing machine. Generally, the washing machine 10 may include a basket 12 for receiving cloth items (not shown) and an agitating device 20. The washing machine 10 may also include a conventional drive system (not shown) for driving the agitating device of the washing machine.

Figure 2:
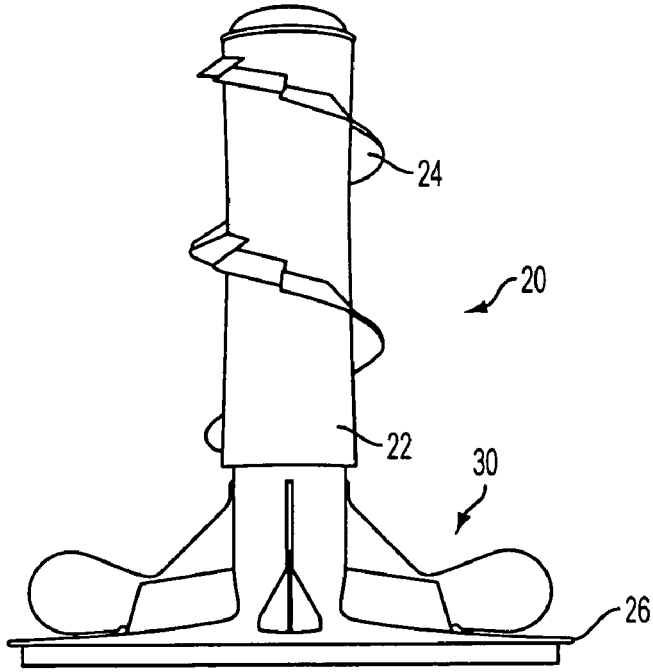
FIG. 2 is a perspective view of an agitating device including the vane of the present invention.

Referring to FIG. 2, an agitating device 20 for use in the washing machine 10 is shown. The agitating device 20 may be an agitator having a center shaft 22 and a skirt 26. It should be understood to those skilled in the art that the skirt 26 could have many different shapes. The center shaft 22 may include a spiral portion 24 extending therefrom for rolling and moving wash liquid and cloth items (not shown) in a circular direction during the wash process of the washing machine 10. The agitating device 20 may include one or more vanes 30 extending therefrom to further move wash liquid and cloth items in a circular direction during the wash process. The vanes 30 may be partially attached to the skirt 26 as shown in FIG. 2, or the vanes 30 may be fully attached to the skirt 26 as shown in FIG. 3B. The vanes 30 may extend in a radial direction toward an outer perimeter of the skirt 26.

Figure 3A:
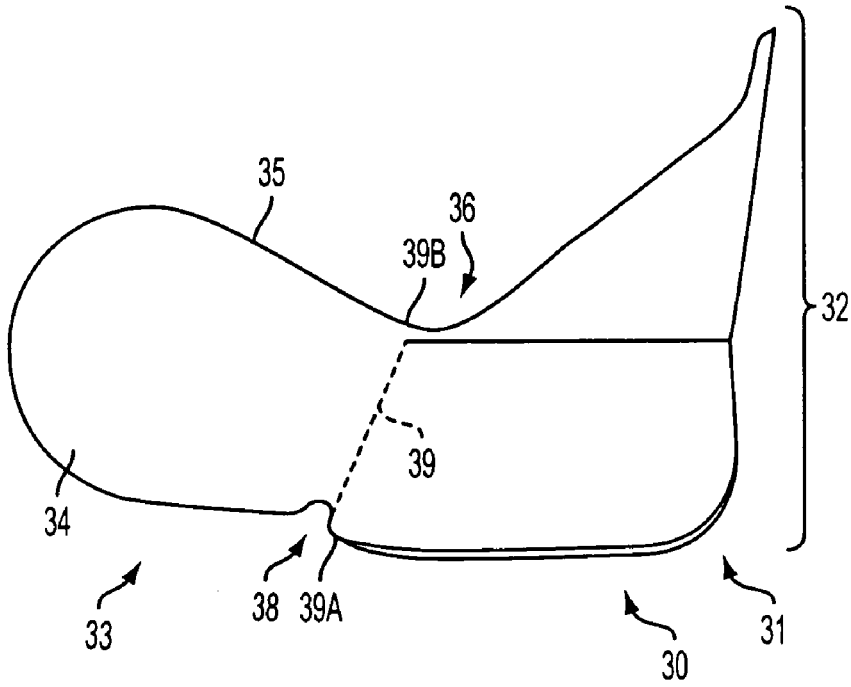
FIG. 3A is a side view of the vane of FIG. 2.
Figure 3B:
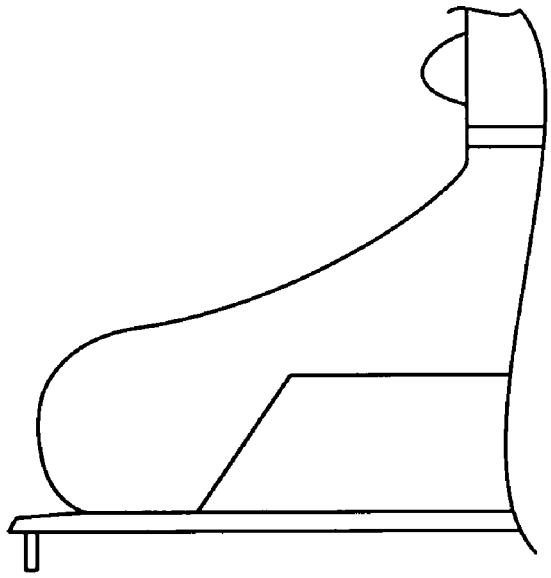
FIG. 3B is a second embodiment of the vane of the present invention.

Referring to FIG. 3A, one embodiment of a vane 30 of the present invention is shown. The vane 30 may include a proximal end 31 located adjacent to the center shaft 22 of the agitating device and having a base portion 32. The base portion 32 may attach the vane to the center shaft 22 of the agitating device 20. The base portion 32 may also attach the vane 30 to the skirt 26 of the agitating device. The vane 30 may further include a distal end 33 located opposite the proximal end 31 and having an enlarged tip 34. The enlarged tip 34 functions to roll the cloth items in the washing machine 10. The enlarged tip 34 may be round, as shown in FIG. 3A, or the enlarged tip 34 may have a different shape. The shape, size, position, and thickness of the vane tip 34 is determined by the amount of vane 30 needed for the desired wash action, which in turn is balanced with the amount of torque that can be provided by the drive system. Preferably, the enlarged tip 34 includes a smooth curve so that it does not wear on the cloth items, thereby reducing fabric abrasion.

The vane 30 may have a hinge point 39A. Moving from the tip of the vane in a direction toward the center shaft 22, the hinge point 39A is the first point where the vane 30 is attached to the skirt 26 and is the point on the vane where the most stress is exerted. The hinge point 39A may comprise a hinge band, such as hinge band 39 shown in FIG. 3C, or, alternatively, multiple hinge points or bands. The location of the particular hinge points or bands of a vane depends upon the geometry of the vane. For example, a further hinge band may be located along the point of attachment of the base portion 32 of the vane to the skirt 26 of the agitating device 20.

The vane 30 also may include a depression 36 located between the proximal end 31 and the distal end 33 on a topside 35 of the vane 30. The depression 36 may have a concave shape, for example. The location of the depression 36 serves to control the angle of the bend of the vane 30 by determining the location of a second hinge point 39B. Thus, a hinge band 39 is created between hinge points 39A and 39B, and the vane may bend along the hinge band 39. As an alternative to the depression 36, the height of the vane 30 may gradually decrease toward the tip 34, as shown in FIG. 3B.

Referring again to FIG. 3A, the vane 30 may further include an indentation 38 for stress relief located on an underside 37 of the vane. The indentation 38 is preferably located at the hinge point 39A between the base portion 32 and the enlarged tip 34. The indentation 38 reduces the stress concentration at the hinge point 39A, and thereby lowers the maximum value of stress at the hinge point 39A by making the change in the geometry from the base portion 32 to the curved enlarged tip 34 of the vane less abrupt. The indentation 38 may have a smooth curvature to lower the stress at the hinge point 39A.

Figure 3C:
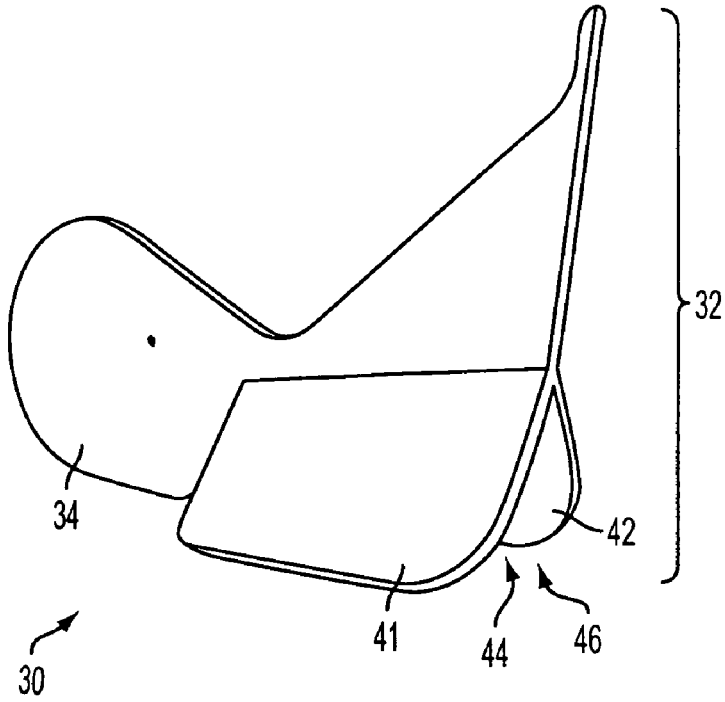
FIG. 3C is a back view of the vane of FIG. 2.
Figure 4:
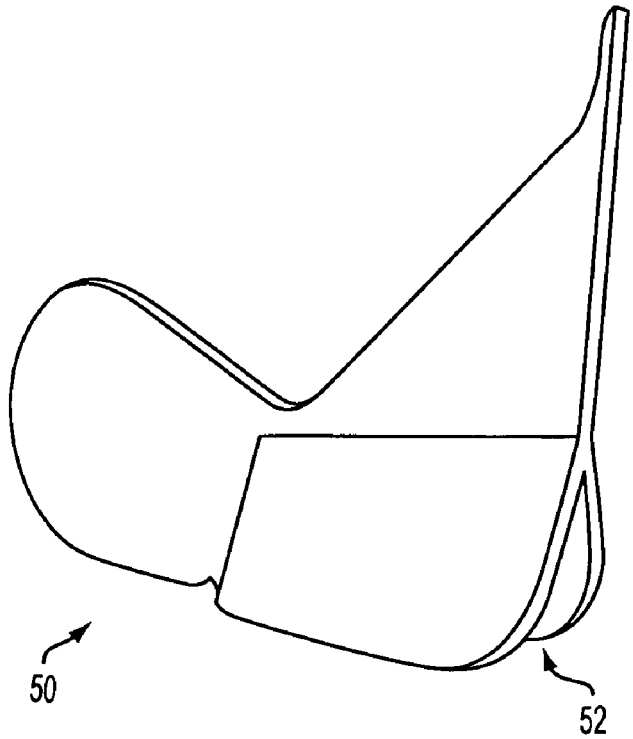
FIG. 4 is a third embodiment of the vane of the present invention.
Figure 5:
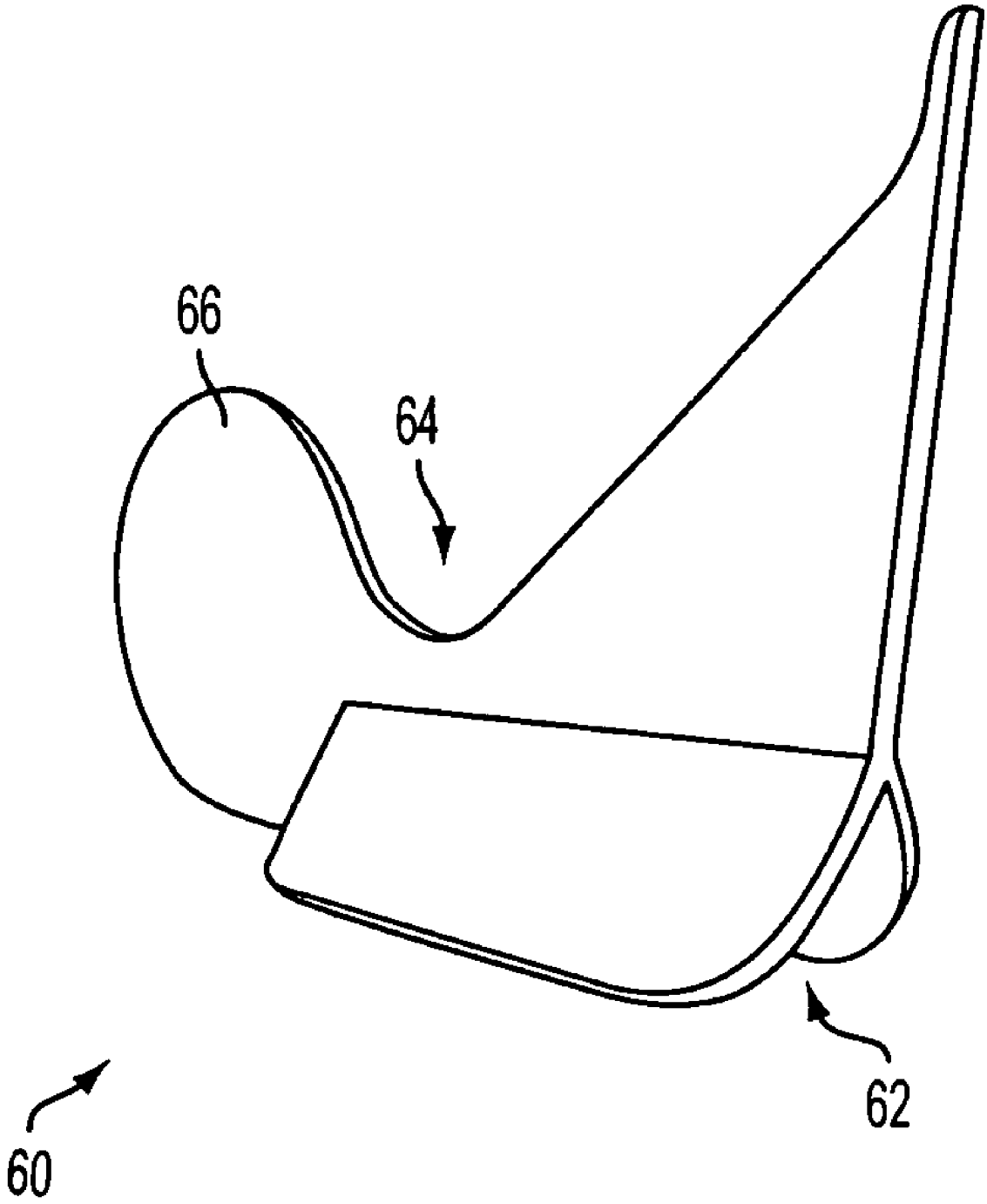
FIG. 5 is a fourth embodiment of the vane of the present invention.

As shown in FIG. 3C, the base portion 32 of the vane 30 may comprise at least two supports 41, 42, defining a cavity 44 therebetween. The cavity 44 may be formed in various shapes and sizes, as shown in FIGS. 4 and 5. In addition to the shape of the cavity shown in FIGS. 3C, 4 and 5, the cavity may have alternate shapes. Referring to FIG. 3C, the cavity 44 may have two flat surfaces 41, 42 defining a trough shape. The front (not shown) of the cavity 44 may be formed by a partial cone, and the back 46 of the cavity may be open to the center shaft 22. Alternatively, the cavity 44 may have any number of supports and thus may take a number of shapes. By splitting the planar vane known in the prior art into a wedge-like support at the base portion 32, the maximum stress value experienced by the vane 30 is reduced because some of the load carried by the vane is distributed between the supports 41, 42 instead of being concentrated at the hinge band 39. The formation of the cavity 44 allows the maximum stress value of the hinge band 39 of vane 30 to decrease without lowering the stress to a point at which the vane becomes less flexible.

Referring to FIGS. 4 and 5, additional embodiments 50, 60 of the vane of the present invention are shown. As shown in FIGS. 4 and 5, the shape of the cavity may vary slightly while still meeting the desired stress level of the hinge point or hinge band of the present invention. For example, in FIG. 4, the shape of cavity 52 is more tapered and narrower than the cavity 44 shown in FIG. 4B. Similarly, in FIG. 5, the shape of the cavity 62 is shorter than the cavity 44 shown in FIG. 3C.

As shown in FIG. 5, the depression 64 of the vane 60 is larger than the depression 36 in FIG. 3C. The larger depression 64 causes the top 66 of the vane 60 to bend more than the bottom of vane, and may affect wash performance. The remaining aspects of the vanes 50 and 60 are the same or similar to those described in vane 30.

In operation, the agitating device 20 oscillates in a back and forth fashion or rotates in one direction to move wash fluid and cloth items (not shown) in a circular direction. The vanes 30 flex to help circulate water and roll the cloth items in a circular motion. The vane design of the present invention allows the necessary amount of flexing while minimizing vane breakage. The circulation of the water and flexing of the vanes 30 work to clean the cloth items during a washing machine wash cycle.

While certain features and embodiments of the present invention have been described in detail herein, it is to be understood that the invention encompasses all modifications and enhancements within the scope and spirit of the following claims.

We claim:

1. An agitating device for a washing machine comprising:

a skirt having a first face and a second face;

a center shaft extending from the first face of the skirt; and at least one vane comprising:

a proximal portion having a base mounted to the center shaft;

a distal portion extending from the proximal portion and separated from the skirt to define a hinge point at the junction of the proximal portion and the distal end portion about which the distal portion flexes to reduce fabric abrasion and promote wash performance; and at least two supports extending downwardly from the proximal portion to the skirt fixing the proximal portion to the skirt to distribute some of the load carried by the vane between the supports and defining a cavity therebetween.

2. The agitating device of claim 1 further comprising an enlarged tip on the distal end portion of the vane.

3. The agitating device of claim 1 wherein the vane further comprises a top side and an underside, the underside being located on the first face of the skirt and the top side being located opposite the underside, and a depression being located on the top side of the vane between the proximal portion and the distal portion of the vane.

4. The agitating device of claim 3 wherein the depression is a concavity.

5. The agitating device of claim 3 further comprising an indentation located on the underside of the vane at the hinge point of the vane.

6. The agitating device of claim 5 wherein the position of the indentation lowers the stress experienced by the hinge point.

7. The agitating device of claim 1 wherein the distal portion of the vane has a curved surface.

8. The agitating device of claim 1 wherein the at least two supports are mounted to the center shaft.

9. An agitating device for a washing machine comprising:

a skirt having a first face and a second face;

a center shaft extending from the first face of the skirt; and at least one vane comprising:

a proximal portion having a base mounted to the center shaft;

a distal portion extending from the proximal portion and separated from the skirt to define a hinge point at the junction of the proximal portion and the distal portion about which the distal portion flexes to reduce fabric abrasion and promote wash performance;

a top side extending from the proximal portion to the distal portion; and at least two supports extending downwardly from the top side to the first face of the skirt fixing the proximal portion to the skirt to distribute some of the load carried by the vane between the supports to support the proximal portion.

10. The agitating device of claim 9 wherein the vane further comprises an underside, the underside being located adjacent the first face of the skirt and opposite the top side, and a depression being located on the top side of the vane at the hinge point of the vane.

11. The agitating device of claim 10 wherein the depression is a concavity.

12. The agitating device of claim 10 further comprising an indentation located on the underside of the vane at the hinge point, wherein the indentation lowers the stress experienced by the hinge point.

13. The agitating device of claim 9 wherein the at least two supports are mounted to the center shaft.

* * * * *

UNITED STATES PATENT AND TRADEMARK OFFICE

CERTIFICATE OF CORRECTION

PATENT NO. : 7,624,602 B2
APPLICATION NO. : 11/442947
DATED : December 1, 2009
INVENTOR(S) : La Belle et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 732 days.

Signed and Sealed this

Twenty-sixth Day of October, 2010

David J. Kappos

David J. Kappos
*Director of the United States Patent and Trademark Office*